US008098867B2

(12) United States Patent
Hampton et al.

(10) Patent No.: US 8,098,867 B2
(45) Date of Patent: Jan. 17, 2012

(54) ATTACHABLE EXTERNAL ACOUSTIC CHAMBER FOR A MOBILE DEVICE

(75) Inventors: Patrick A. Hampton, Deerfield Beach, FL (US); Narendra Persaud, Sunrise, FL (US)

(73) Assignee: Motorola Mobility, Inc., Libertyville, IL (US)

( * ) Notice: Subject to any disclaimer, the term of this patent is extended or adjusted under 35 U.S.C. 154(b) by 1211 days.

(21) Appl. No.: 11/675,118

(22) Filed: Feb. 15, 2007

(65) Prior Publication Data

US 2008/0130931 A1 Jun. 5, 2008

Related U.S. Application Data

(60) Provisional application No. 60/867,990, filed on Nov. 30, 2006.

(51) Int. Cl.
*H04R 25/00* (2006.01)

(52) U.S. Cl. ..... 381/345; 381/333; 381/388

(58) Field of Classification Search ..... 381/305, 381/306, 311, 333, 335, 337–339, 351, 382, 381/388

See application file for complete search history.

(56) References Cited

U.S. PATENT DOCUMENTS

| | | | |
|---|---|---|---|
| 4,268,718 | A | 5/1981 | Clark, Jr. |
| 4,856,071 | A | 8/1989 | Marquiss |
| 5,286,928 | A | 2/1994 | Borland |
| 5,696,367 | A | 12/1997 | Keith |
| 5,783,780 | A | 7/1998 | Watanabe et al. |
| 5,892,183 | A | 4/1999 | Roozen et al. |
| 5,963,640 | A | 10/1999 | Rabe |
| 5,974,157 | A | 10/1999 | Tajima et al. |
| 6,002,949 | A | 12/1999 | Hawker et al. |
| 6,064,894 | A | 5/2000 | Zurek et al. |

(Continued)

FOREIGN PATENT DOCUMENTS

AT 409910 B 4/2002

(Continued)

OTHER PUBLICATIONS

Andrey K. Morozov, Douglas C. Webb; "A Sound Projector for Acoustic Tomography and Global Ocean Monitoring"; pp. 174-185; Apr. 2003.

*Primary Examiner* — Suhan Ni
(74) *Attorney, Agent, or Firm* — Stephen H. Shaw

(57) ABSTRACT

An external acoustic chamber (220) for attachment to a mobile device (200) is provided. The external acoustic chamber (220) optimizes the audio performance of the mobile device (200) thus reducing the need for signal equalization and/or hardware to amplify the sound signal. The mobile device (200) includes a loudspeaker (205) and a first acoustic chamber (207) acoustically coupled to the loudspeaker (205). The external acoustic chamber (220) comprises at feast a second acoustic chamber (222) which penetrates the first acoustic chamber (207) adding volume to the first acoustic chamber (207). The combined greater volume reduces the dampening of loudspeaker (205) caused by the pressure in the first acoustic chamber (207). The result is an improvement in the frequency response of loudspeaker (205) approaching the natural frequency response of loudspeaker (205). The at least second acoustic chamber (222) is sized and shaped so that a first exterior surface portion of the acoustic chamber (220) covers or is flush with the battery (214) installed in the housing (201) of the mobile device (200). The first, exterior surface portion is substantially aligned with a second exterior surface portion enclosing the at least second acoustic chamber (222).

18 Claims, 12 Drawing Sheets

U.S. PATENT DOCUMENTS

| | | | | |
|---|---|---|---|---|
| 6,104,808 | A | 8/2000 | Alameh et al. | |
| 6,144,751 | A | 11/2000 | Velandia | |
| 6,275,597 | B1 | 8/2001 | Roozen et al. | |
| 6,359,994 | B1 | 3/2002 | Markow et al. | |
| 6,411,720 | B1 | 6/2002 | Pritchard | |
| 6,411,722 | B1 * | 6/2002 | Wolf | 381/382 |
| 6,473,625 | B1 | 10/2002 | Williams et al. | |
| 6,634,455 | B1 | 10/2003 | Yang | |
| 6,636,750 | B1 | 10/2003 | Zurek et al. | |
| 6,758,303 | B2 | 7/2004 | Zurek et al. | |
| 7,092,745 | B1 | 8/2006 | D'Souza | |
| 7,280,666 | B2 | 10/2007 | Guyot et al. | |
| 7,324,655 | B2 | 1/2008 | Sato | |
| 7,343,181 | B2 | 3/2008 | Chan et al. | |
| 7,382,048 | B2 | 6/2008 | Minervini | |
| 7,447,009 | B2 * | 11/2008 | Wang et al. | 381/306 |
| 2001/0039200 | A1 | 11/2001 | Azima et al. | |
| 2002/0027999 | A1 | 3/2002 | Azima et al. | |
| 2003/0068063 | A1 | 4/2003 | Usuki et al. | |
| 2004/0028246 | A1 | 2/2004 | Maekawa et al. | |
| 2004/0165359 | A1 | 8/2004 | Cheng et al. | |
| 2005/0031148 | A1 | 2/2005 | McNary | |
| 2005/0190941 | A1 | 9/2005 | Yang | |
| 2007/0019820 | A1 | 1/2007 | Zurek et al. | |
| 2007/0025582 | A1 | 2/2007 | Rashish et al. | |
| 2007/0029131 | A1 | 2/2007 | Pan et al. | |
| 2007/0189566 | A1 | 8/2007 | Yamagishi et al. | |
| 2009/0129623 | A1 | 5/2009 | Weckstrom et al. | |
| 2009/0169041 | A1 | 7/2009 | Zurek et al. | |

FOREIGN PATENT DOCUMENTS

| | | | |
|---|---|---|---|
| FR | 2770734 | A1 | 7/1999 |
| JP | 2005136895 | A | 5/2005 |
| JP | 20065616 | A1 | 1/2006 |
| JP | 3997133 | B2 | 10/2007 |
| KR | 200144783 | Y1 | 6/1999 |
| KR | 1020040040519 | A | 5/2004 |
| KR | 200417799 | Y1 | 6/2006 |
| WO | 2007111650 | A1 | 10/2007 |

* cited by examiner

ATTACHABLE EXTERNAL ACOUSTIC CHAMBER FOR A MOBILE DEVICE

CROSS REFERENCE TO RELATED APPLICATIONS

This application claims the benefit of priority to U.S. provisional patent application Ser. No. 60/867,990 filed on Nov. 30, 2006, which is incorporated by reference as if fully rewritten herein.

BACKGROUND OF THE INVENTION

Statement of the Technical Field

The invention relates to accessories for mobile devices. More particularly, this invention relates to an attachable external acoustic chamber for mobile devices to improve the audio performance and define a seamless, aesthetically pleasing mobile device casement profile.

Background of the Invention

The demand for mobile devices such as cellular telephones in recent years has been steadily increasing. As a result, the number of manufacturers of mobile devices and the competition among them has increased. This competition has forced mobile device designers to design mobile devices with additional features and capabilities to remain competitive. Typically, consumers prefer cellular telephones with longer talk time and standby time. The talk time and standby time depend on, among other things, the capacity of the battery that provides electrical power. There are many factors which determine the capacity of a battery for a mobile device. These factors include the materials used to manufacture the battery and the size of the battery. Accordingly, these factors affect the cost and weight of the battery. Mobile device designers must weigh all of these factors when selecting a battery for a mobile device for a particular model of mobile device.

One of the more recent popular features that have been incorporated into mobile devices is a loudspeaker. A loudspeaker allows the user to use the cellular telephone in a hands-free configuration without the use of headsets. Typically, in addition to the traditional mouthpiece and earpiece, a mobile device with a loudspeaker will have the loudspeaker in a front mounted or rear mounted configuration. The loudspeaker should have sufficient volume that it can be heard without holding the loudspeaker to the user's ear. Most mobile devices equipped with a loudspeaker feature have a switch which is depressed to activate the loudspeaker mode.

One drawback to incorporating the loudspeaker feature into a mobile device is that less volume is available for the loudspeaker in smaller sized mobile devices because of the smaller battery sizes that must be used. Thus, the function of the loudspeaker is less than optimal. One solution to this problem is for manufacturers of mobile devices to offer an aftermarket battery with greater power capacity that replaces the original battery. Such batteries are larger in size and are encased in a cover that typically extends further out of the battery chamber than the original battery. The result is a mobile device with an unsatisfactory casement profile.

Another drawback to a mobile device incorporating a loudspeaker is that the volume of the front or rear ported loudspeaker may not be optimal due to size constraints imposed on the phone ID.

There exists in the art an attempt to improve the audio performance of a cellular telephone. For example, in U.S. patent application no. 2005/0190941 A1, disclosed is a cellular telephone having a first opening for delivering voice on a shell. A printed circuit board (PCD) is disposed within an inner space enclosed by the shell and divides the inner space into a first acoustic room and a second acoustic room. A speaker is disposed within the first acoustic room and electrically connects the PCB. A through hole is formed on the PCB to communicate the first acoustic room and the second acoustic room to increase the size of total resonance chamber for improving resonance effect in low frequency voices. Furthermore, at least a second opening is formed on the shell to communicate the first acoustic room or the second acoustic room to the environment for flattening the resonance curve to improve the voice quality. However, the cellular phone disclosed does not have a loudspeaker and there is no attempt to improve the audio performance thereof.

Consequently, there exists a need in the art for a mobile device having an aesthetically pleasing casement profile when an extended capacity battery is installed in the battery cavity. There also exists a need in the art to improve the audio performance of a mobile device having a loudspeaker.

SUMMARY OF THE INVENTION

The invention concerns an external acoustic chamber for attachment to a wireless mobile electronic device. The wireless mobile electronic device comprises a first housing, a first acoustic chamber disposed within the first housing, a sound generator within the first housing acoustically coupled to the first acoustic chamber, a second housing defining at least a second acoustic chamber, the second housing is removably attached to the first housing, and at least a first acoustic port configured for acoustically coupling the first acoustic chamber to the second acoustic chamber when the second housing is attached to the first housing.

The at least first acoustic chamber further comprises at least a second acoustic port formed in the first housing for communicating audio from the sound generator to an exterior of the first and second housing. There is a third acoustic chamber disposed in the second housing, and a third acoustic port configured for acoustically coupling the sound generator to the third acoustic chamber.

In the exemplary embodiment of the invention, the at least first acoustic port defines an opening info the first acoustic chamber, the at least first acoustic port comprising a first mating structure configured for mating with a second mating structure of a second acoustic chamber exclusive of the first housing. The first mating structure comprises a socket formed on a portion of the first housing. The second mating structure is comprised of a hollow tubular structure extending from a portion of the second housing. The first mating structure or socket is sized and shaped for snugly mating with the second mating structure or hollow tubular structure when the second housing is attached to the first housing. The at least first acoustic port is configured for acoustically coupling the at least first acoustic chamber to the second acoustic chamber when the second housing is attached to the first housing.

There is a removable sealing member disposed in the opening of the at least first acoustic port for sealing the at least first acoustic port when the second housing is not attached to the first housing.

In the exemplary embodiment of the invention, the second housing further comprises a cover for a battery installed in the first housing of the wireless mobile electronic device. The battery is contained at least partially within the second housing. The battery has a size and shape which protrudes from the first housing, and the second acoustic chamber is sized and shaped so that a first exterior surface portion of the second housing covering the battery is substantially aligned with a second exterior surface portion of the second housing enclosing the second acoustic chamber.

In another embodiment of the invention, there is at least one sensing device configured for detecting when the second housing is attached to the first housing. There is an audio processing means configured to modify an amplitude of selected audio frequencies communicated to the sound generator responsive to the sensing device. The at least one sensing device is selected from the group consisting of a Hall effect sensor, a magnetic sensor, and a switch.

In another embodiment of the invention, the second housing further comprises first and second side portions which extend beyond peripheral edges of the first housing when the second housing is attached to the first housing. The first and second portions define a channel extending the third acoustic chamber beyond the peripheral edges of the first housing. The first and second side portions each define an opening configured for communicating audio from the sound generator to an exterior of the second housing.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Figure 1A:
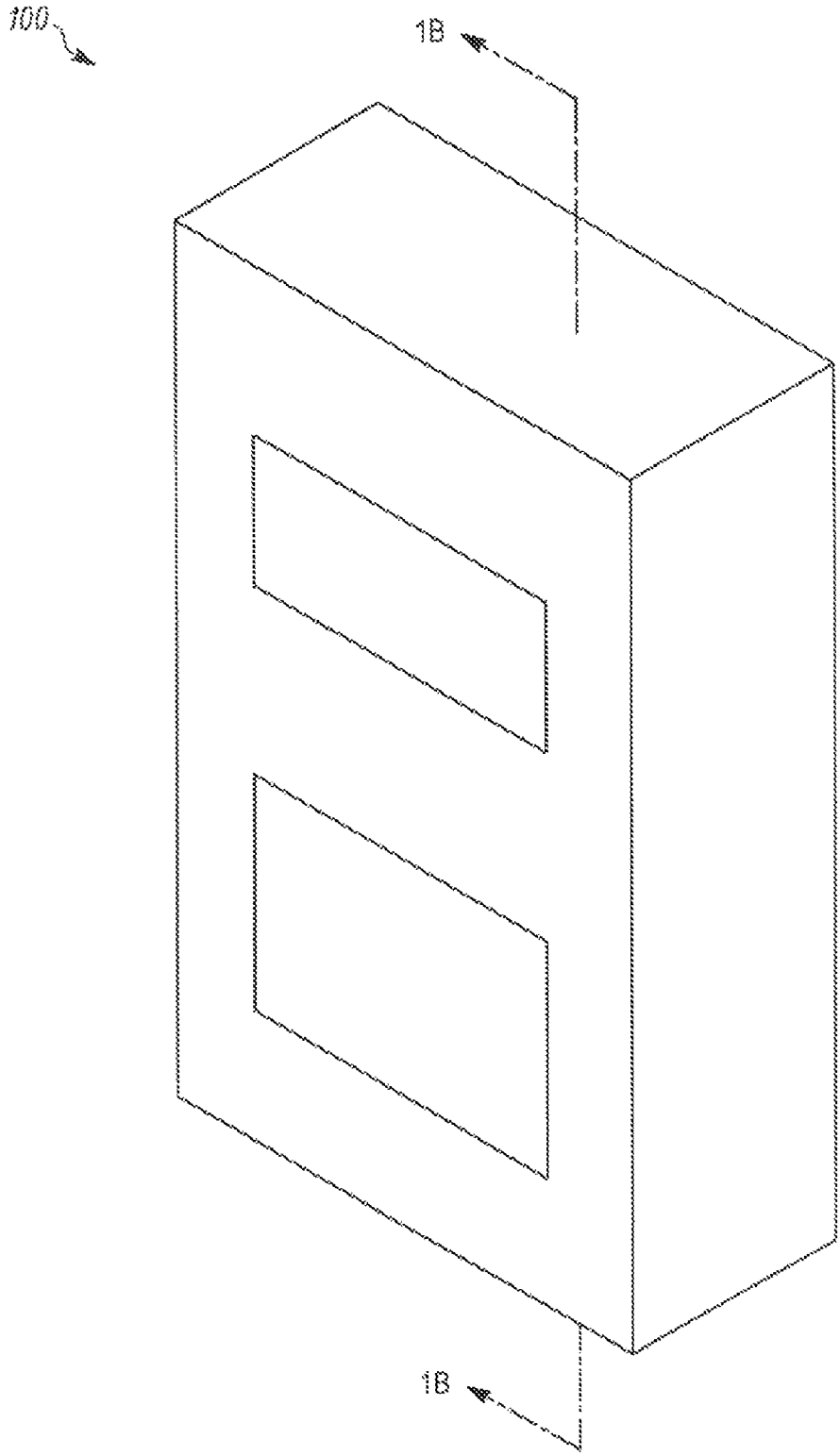
PRIOR ART FIG. 1A
FIG. 1A is a perspective view of an exemplary prior art mobile device.

Referring now to FIG. 1A, shown is a front perspective view of an exemplary prior art mobile device 100. The mobile device 100 could be any type of mobile device but the most typical application can include a cellular telephone.

Figure 1B:
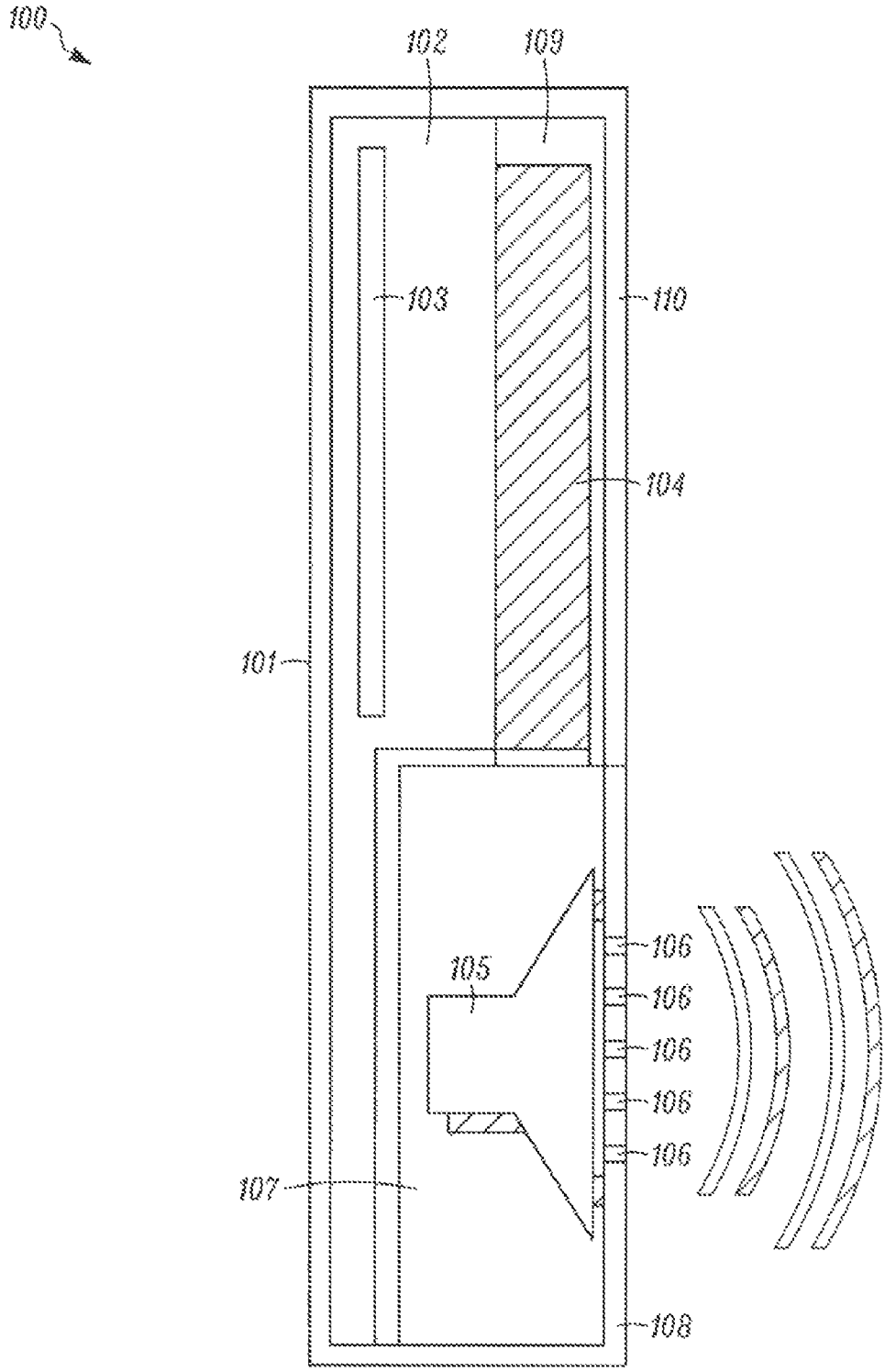
PRIOR ART FIG. 1B
FIG. 1B is a cross-sectional side view of the exemplary prior art mobile device of FIG. 1A taken along line 1B-1B of FIG. 1A with a conventional thin battery and battery cover.

Referring now to FIG. 1B, shown is a cross-sectional side view of the exemplary prior art mobile device 100 shown in FIG. 1A taken along line 1B-1B of FIG. 1A. The prior art mobile device 100 can include a loudspeaker 105. The loudspeaker 105 is useful for having a hands-free telephone conversation without having to hold the mobile device 100 close to the mouth and ears of the user. The loudspeaker 105 is also useful in hosting a conference call where more than one person can attend the conference call in the proximity of the mobile device 100.

The loudspeaker 105 is rear ported resulting in the audio or front volume sound generated by loudspeaker 105 being directed out of the rear side of the mobile device 100. The mobile device 100 also includes at the very least a shell 101 defining an interior space 102 housing a circuit board 103, a battery 104 for providing electrical power to circuit board 103, and the loudspeaker 105. The circuit board 103 contains the operational electronics components comprising the mobile device 100 such as a numeric keypad, display, microprocessor, receiver/transmitter, microphone, and earpiece (none of which are shown). The loudspeaker 105 is connected to the circuit board 103. Typically, the audio output of the earpiece (not shown) is muted and the sensitivity of the microphone (not shown) is increased when the loudspeaker 205 feature is activated.

The battery 104 is a "thin" battery design having only ordinary battery capacity as is known to one of ordinary skill in the art. The battery 104 could be inserted and housed in a recess 109 defined by a portion of shell 101 in the rear of shell 101. A cover 110 could then be installed over the recess 109 to secure battery 104 in the recess 109. The battery 104 could also be formed as part of the cover 110 and the composite assembly inserted into recess 109 and attached to the shell 101 of mobile device 100. When battery 114 and cover 115 are installed on mobile device 100, cover 115 fits into the contours of shell 101 such that a seamless, aesthetically pleasing mobile device 100 casement profile is defined.

The shell 101 is further comprised of an acoustic chamber 107 acoustically coupled to the rear side of loudspeaker 105. An acoustic chamber is an enclosure that minimizes or attenuates noise. The acoustic chamber 107 absorbs the rear volume sound generated by loudspeaker 105. The acoustic chamber 107 prevents the radiation of the rear volume sound of loudspeaker 105 to an outside area where it may interfere with other sound sensitive components of the mobile device 100.

One or more ports 106 are formed in the sidewall 108 of shell 102 in the area in front of loudspeaker 105. The ports 106 allow the front volume sound of loudspeaker 105 to be directed out of the rear side of the mobile device 100.

Figure 1C:
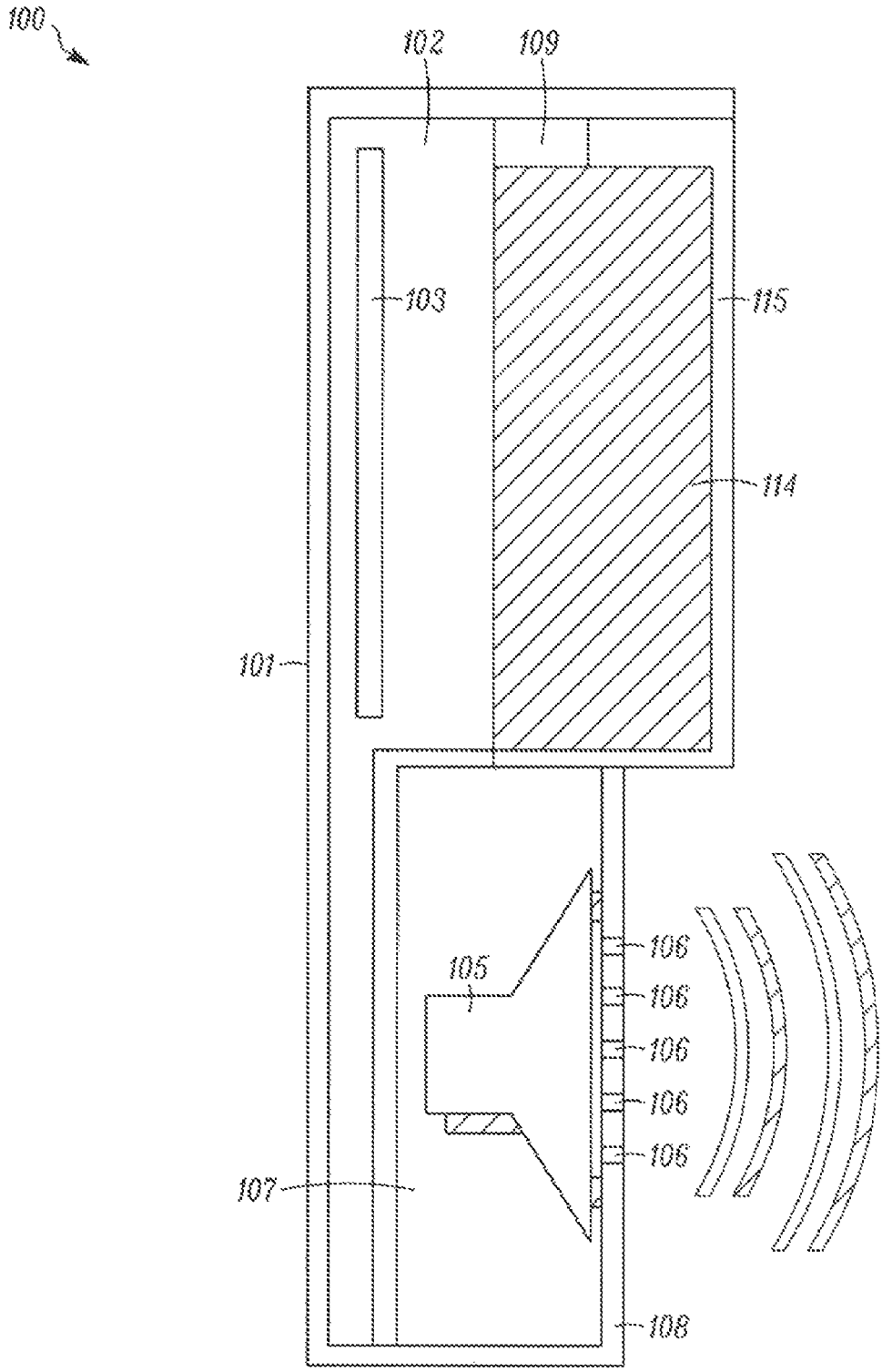
PRIOR ART FIG. 1C
FIG. 1C is a cross-sectional side view of the exemplary prior art mobile device of FIG. 1A taken along line 1B-1B of FIG. 1A with an extended capacity battery and an extended capacity battery cover.

Referring now to FIG. 1C, shown is another cross-sectional side view of the exemplary prior art mobile device 100 of FIGS. 1A and 1B. The mobile device 100 is identical to the mobile device 100 of FIGS. 1A and 1B except that an "extended" or "high" capacity battery 114 has been inserted into recess 109 and secured therein with a cover 115. The battery 114 is termed an "extended" or "high capacity" battery because it has more electrical power available than traditional "thin" batteries used in a mobile device 100. The additional electrical power provided by battery 114 gives the mobile device 100 heightened capabilities such as a longer talk time or standby time.

However, "extended" or "high capacity" type batteries are larger than traditional "thin" batteries and do not completely fit into the recess 109 of mobile device 100. The way this has been resolved is to allow a portion of the battery 114 to protrude from recess 109 while a portion of battery 114 is inserted into recess 109. This requires that the cover 115 also be designed to conform around the portion of battery 114 protruding from recess 109. When battery 114 and cover 115 are installed on mobile device 100, the cover 115 is discontinuous with the contours of shell 101 and distorts the seamless, aesthetically pleasing casement profile of mobile device 100 of FIGS. 1A and 1B to an otherwise aesthetically less than satisfactory mobile device 100 casement profile.

Figure 2A:
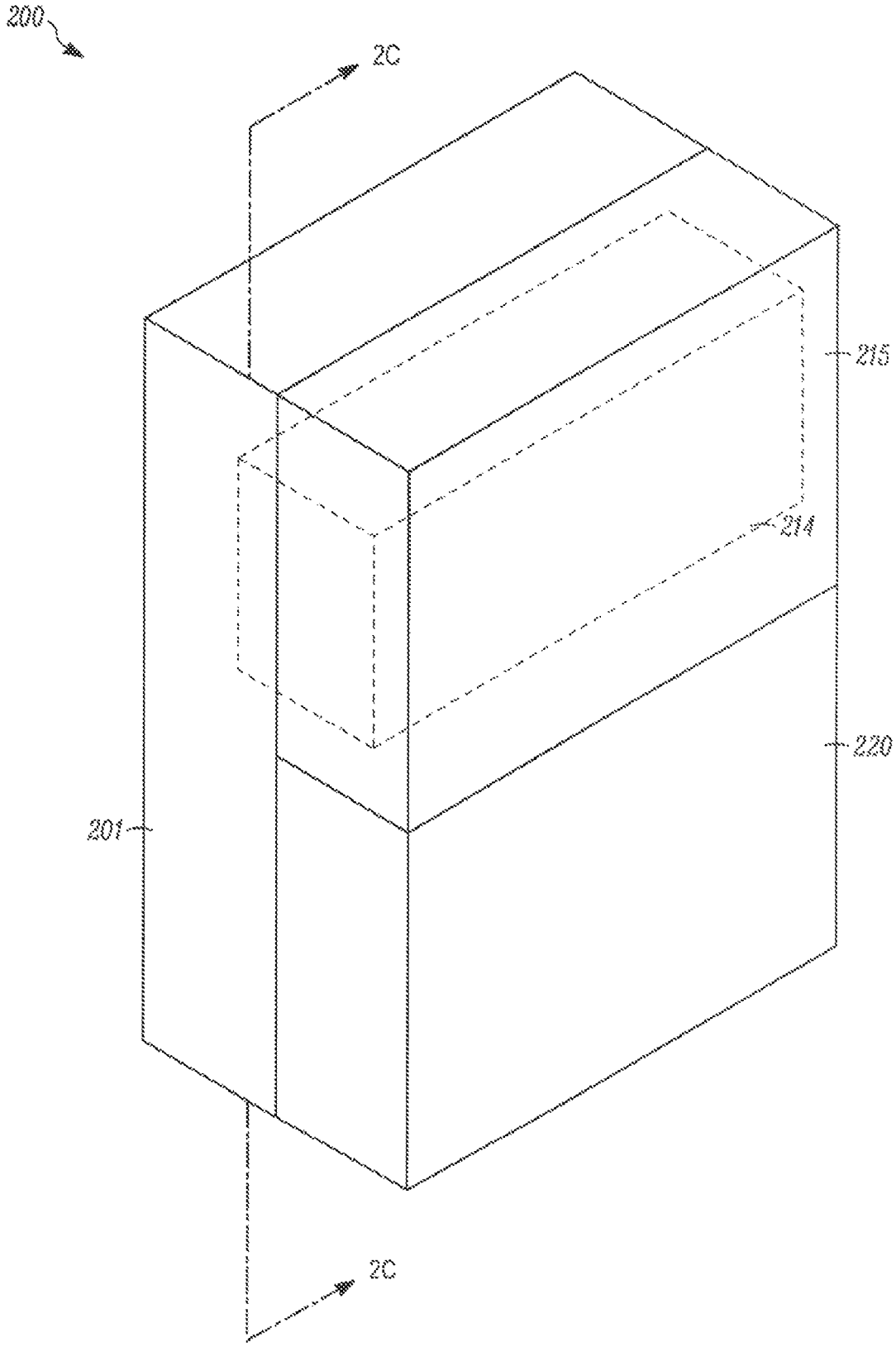
FIG. 2A is a perspective view of an exemplary embodiment of a mobile device.

Referring now to FIGS. 2A and 28, shown are rear perspective and exploded rear perspective views of an exemplary embodiment of a mobile device 200 having an extended capacity battery 214 and battery cover 215 attached to the rear of the mobile device 200. Also shown is an external acoustic chamber 220 attached to the rear side of mobile device 200 beneath the battery cover 215. The mobile device 200 could be a cellular telephone but the invention is not limited in this regard. In the embodiment shown, the loudspeaker 205 is rear ported so that the audio or front volume sound of loudspeaker 205 is directed out the rear of mobile device 205.

Figure 2B:
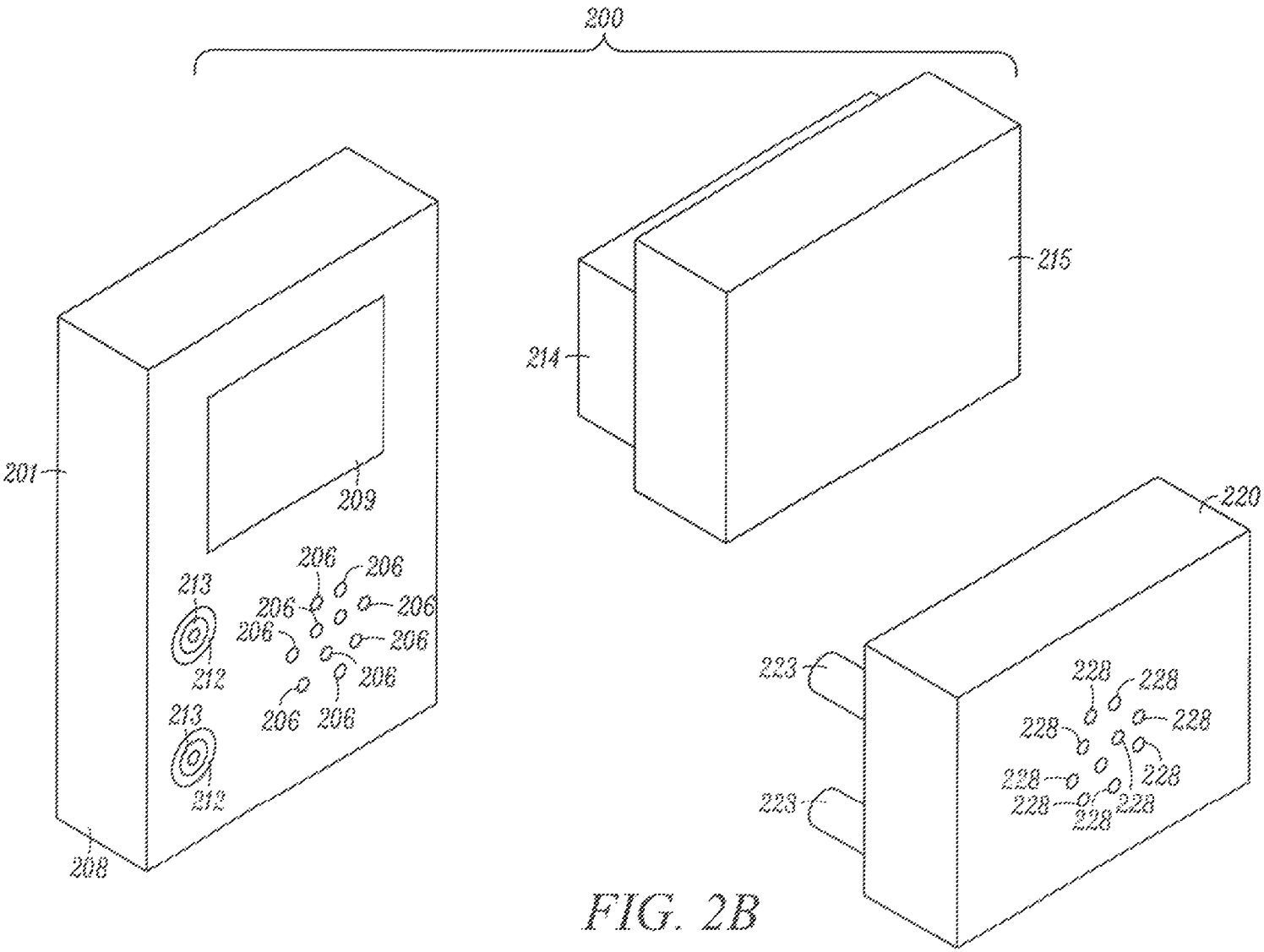
FIG. 2B is an exploded perspective view of the exemplary embodiment of the mobile device shown in FIG. 2A.
Figure 2C:
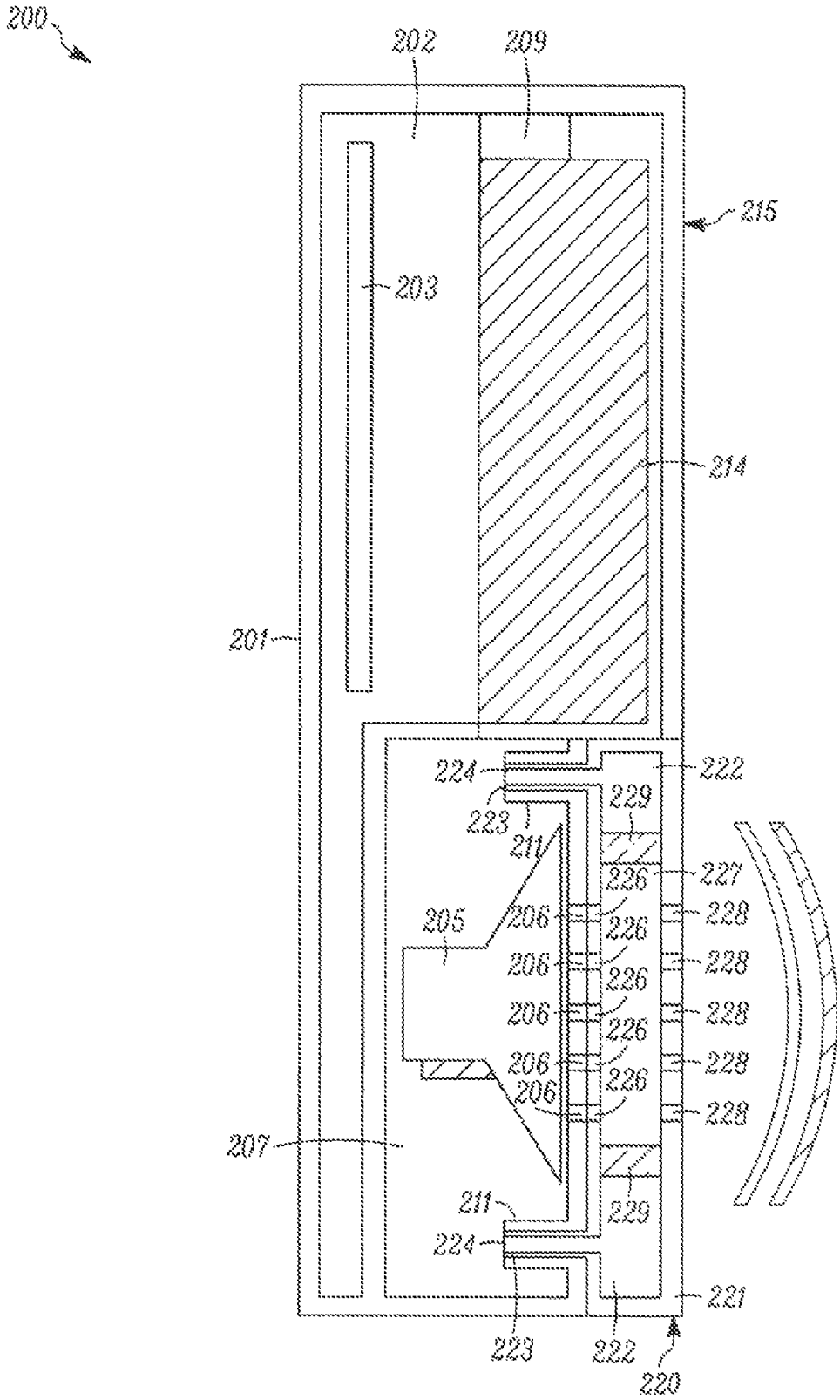
FIG. 2C is a cross sectional side view of the exemplary embodiment of a mobile device shown in FIG. 2A taken along line 2C-2C of FIG. 2A having an extended capacity battery, extended capacity battery cover, a rear ported loudspeaker, and an external acoustic chamber attached.
Figure 2D:
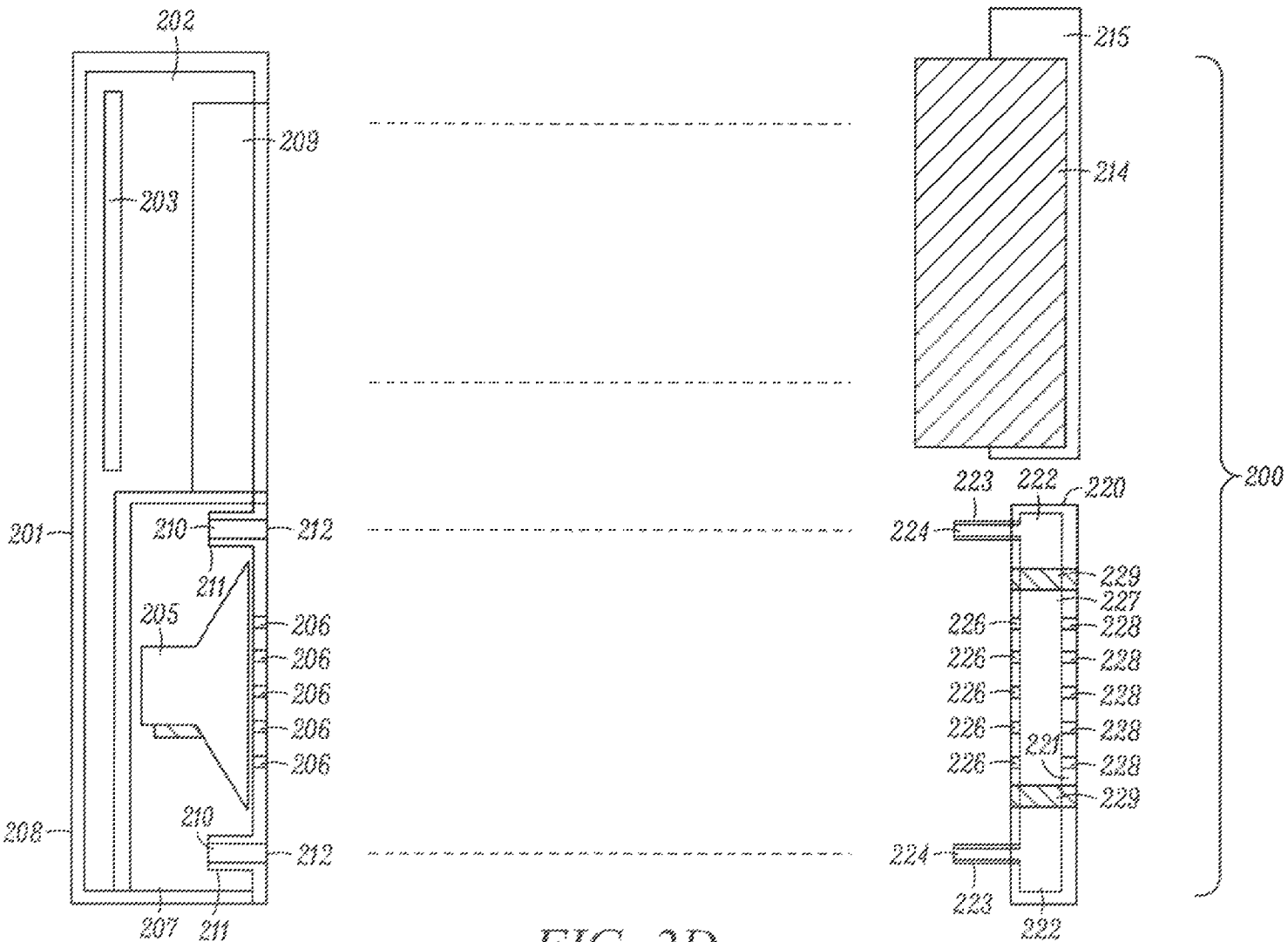
FIG. 2D is an exploded cross-sectional side view of the mobile device of FIG. 2C.

Referring now to FIGS. 2C and 2D and still to FIGS. 2A and 2B, shown are cross-sectional side and exploded cross-sectional side views of the mobile device 200. Both the cross-sectional side view of FIG. 2C and the exploded cross-sectional side view of FIG. 2D are taken along line 2C-2C of FIG. 2A. The mobile device 200 is similar to the prior art mobile device of FIGS. 1A-1C. The mobile device 200 includes at the very least a first housing or shell 201 defining an interior-space 202 housing a circuit board 203, a battery 214 for providing electrical power to circuit board 203, and a sound generator such as loudspeaker 205. The circuit board 203 contains the operational electronics components comprising the mobile device 200 such as a numeric keypad, display, microprocessor, receiver/transmitter, microphone, and earpiece (none of which are shown). The loudspeaker 205 is connected to the circuit board 203. The loudspeaker 205 is acoustically coupled to a first acoustic chamber 207.

The battery 214 is of the extended or high capacity type and consequently has an extended profile when installed in a recess 209 defined in a portion of shell 201. A cover 215 is fitted over battery 214 and encases battery 214 in recess 209. Alternately, battery 214 and cover 215 can be integrally formed and inserted as a composite arrangement into recess 109. Similar to the prior art mobile device 100 in FIG. 1C, when battery 214 is installed in recess 209 a portion of battery 214 protrudes from recess 209 and cover 215 is fitted over the protruding portion. The result is a less than satisfactory aesthetic mobile device 200 casement profile.

One other problem associated with a loudspeaker 205 in a mobile device 200 such as the rear ported loudspeaker 205 shown in FIGS. 2C and 2D is that the audio performance of the loudspeaker 205 is usually less than desired or less than it could be. For example, in the prior art mobile device 100 of FIGS. 1A-1C, the audio or front volume sound of the loudspeaker 105 is directed out the rear of the mobile device 100 through the one or more ports 106. The natural frequency response of loudspeaker 105 is dampened by the pressure in the acoustic chamber 107 disposed within the shell 201 and acoustically coupled to loudspeaker 105. In the prior art mobile device 100 of FIGS. 1A-1C, this loss of the natural frequency response is somewhat compensated for electronically by equalization (EQ). Still, this compensation is less than the natural frequency response of loudspeaker 105 would be if loudspeaker 105 was not dampened by the pressure in acoustic chamber 107.

The present invention solves this problem by attaching an external acoustic chamber 220 to the rear of the mobile device 200. The external acoustic chamber 220 is defined by a second housing 221 that attaches to the sidewall 208 of shell 201. The second housing 221 could be attached to shell 201 directly beneath battery 214 and cover 215. However, the invention is not limited in this regard as the external acoustic chamber 220 could be attached at other locations on the mobile device 200. The external acoustic chamber 220 is comprised of at least one second acoustic chamber 222 and a third acoustic chamber 227. At least one sidewall 229 divides the external acoustic chamber 220 into the at least one second acoustic chamber 222 and the third acoustic chamber 227.

When battery 214 is installed in recess 209 and cover 215 and external acoustic chamber 220 are attached to the rear of mobile device 200, the result is a seamless, aesthetically pleasing mobile device 200 casement profile (best seen in FIG. 2A). Alternately, external acoustic chamber 220 could be integrally formed with battery 214 and cover 215 so that the composite arrangement could be attached to the rear of mobile device 200. The composite arrangement also provides a seamless, aesthetically pleasing mobile device 200 casement profile when installed on mobile device 200.

It is envisioned that the external acoustic chamber 220 could be sold separately as an aftermarket product to consumers who wish to improve the audio performance of their mobile device 200. This may especially appeal to consumers who have already purchased a high capacity battery 214 and cover 215 which results in the mobile device 200 having a less than satisfactory aesthetic profile. The addition of the external acoustic chamber 220 beneath the battery 214 and cover 215 results in a seamless, aesthetically pleasing mobile device 200 casement profile.

It is also envisioned that a composite external acoustic chamber 220 and high capacity battery 214 and cover 215 arrangement could be sold as an aftermarket product. This product would appeal to consumers who wish to improve the capability of their mobile device 200 while simultaneously improving the audio performance of the loudspeaker 205. This arrangement is especially desirable since the composite arrangement provides a seamless, aesthetically pleasing mobile device 200 casement profile.

The external acoustic chamber 220 improves the audio performance of the mobile device 200 by penetrating the first acoustic chamber 207 acoustically coupled to loudspeaker 205. The volume of first acoustic chamber 207 is acoustically coupled to the volume of the at least one second acoustic chamber 222 to improve the low end frequency response of loudspeaker 205. The greater combined volume or acoustic space reduces the dampening of loudspeaker 205 caused by the pressure within the first acoustic chamber 207. The result is a frequency response of loudspeaker 205 that approaches the natural frequency response of loudspeaker 205.

The external acoustic chamber 220 penetrates the volume of the first acoustic chamber 207 by one or more acoustic plugs or tubes 223 that acoustically couples the at least one second acoustic chamber 222 to the first acoustic chamber 207. The one or more tubes 223 are inserted into complementary respective one or more sockets 212 (FIG. 2B) defined in sidewall 208 (FIG. 2B) of shell 201. The one or more tubes 223 and one or more sockets 212 serve as one or more ports acoustically coupling the first acoustic chamber 207 and the at least one second acoustic chamber 222. A seal 213 may also be provided in each of the one or more sockets 212 to seal the one or more tubes 224 when inserted into the respective socket 212. The seal 213 could also be used to seal the one or more sockets 212 and the first acoustic chamber 207 before the external acoustic chamber 220 is attached to mobile device 200. Each of the one or more sockets 212 define an opening into a channel 210 formed in a cylindrical boss 211. The one or more tubes 223 are seated in the channel 210 in the cylindrical boss 211 in a frictional type fit. Each of the one or more tubes 223 define a channel 224 that is connected to one of the second acoustic chambers 222. It should be understood that the acoustic plugs or tubes 223 and the boss 211 are cylindrical in the exemplary embodiment. However, the invention is not limited in this regard as the tubes 223 and the boss 211 could be any cross-sectional shape such as square, elliptical, octagonal or other shape known to one of ordinary skill in the art.

The audio or front volume sound of loudspeaker 205 passes through a plurality of ports 206 formed in sidewall 208 of shell 202. When the acoustic chamber 220 is attached to the rear of mobile device 200, the plurality of ports 206 are aligned with a plurality of ports 226 formed on a first sidewall of second housing 221 to allow the front volume sound of loudspeaker 205 to enter the third acoustic chamber 227. The front volume sound then exits the third acoustic chamber 227 through a plurality of ports 228 on a second sidewall of second housing 221 opposed from said first sidewall.

Figure 5:
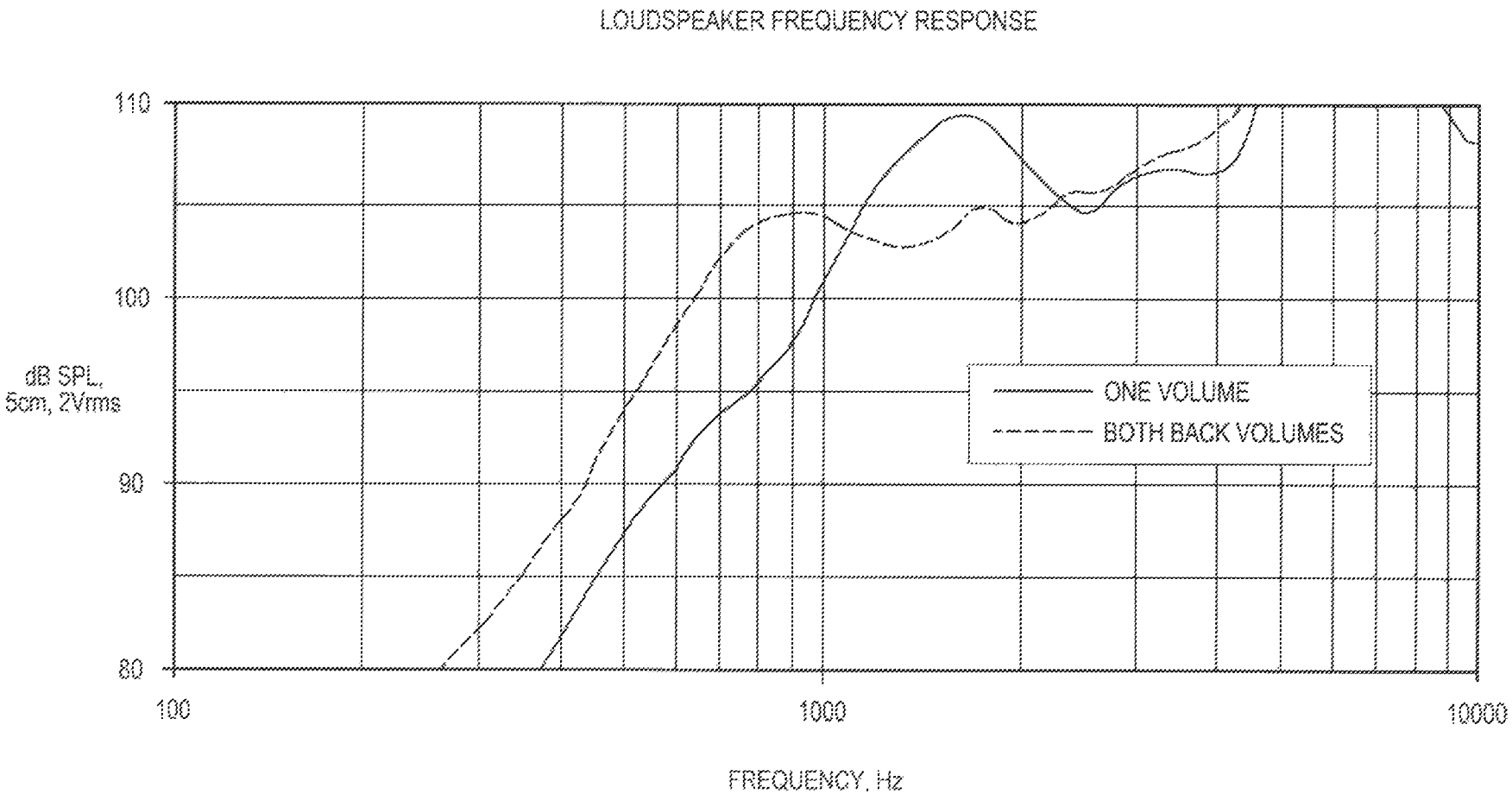
FIG. 5 is a graph comparing the frequency response of a loudspeaker for a traditional mobile device to a loudspeaker for a mobile device with an external acoustic chamber attached.

As discussed, the additional volume provided by the external acoustic chamber 220 acoustically coupled to the first acoustic chamber 207 improves the low end frequency response of loudspeaker 205. For example, shown in FIG. 5 is a graph of the improved low end frequency response of loudspeaker 205 for a mobile device 200. The solid line represents the frequency response of a traditional prior art mobile device 100 without an external acoustic chamber 220. The dashed lines represents the frequency response of a mobile device 200 of the present invention with an external acoustic chamber 220 attached. As can be seen, there is an improvement in the sound pressure level (SPL) in the low end frequency response under the frequency of approximately 900 hertz. There is an average 7 db gain for the mobile device 200 with the external acoustic chamber 220 attached in the frequency range from 200 to 1000 hertz. The improvement of the frequency response of loudspeaker 205 depends on factors such as the size of the loudspeaker 205, the number of tubes 223 and sockets 212, the volume of the first acoustic chamber 207, and the volume of the at least one second acoustic chamber 222.

Figure 2E:
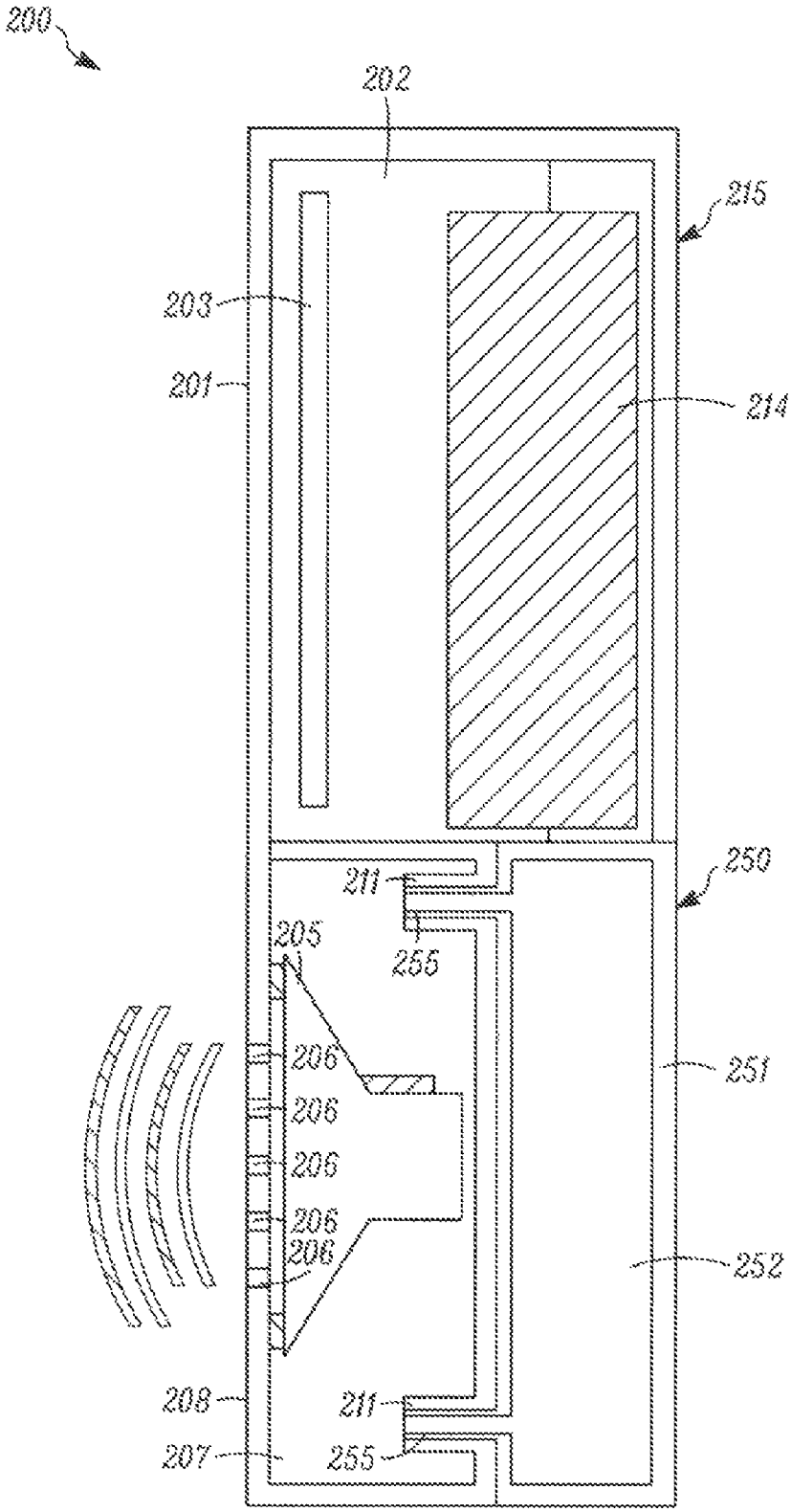
FIG. 2E is a cross-sectional side view of another embodiment of the mobile device of FIG. 2A taken along line 2C-2C of FIG. 2A having an extended capacity battery, extended capacity battery cover, front ported loudspeaker, and an external acoustic chamber attached.

Referring now to FIG. 2E, shown is a cross-sectional side view of another embodiment of a mobile device 200 similar to the one shown in FIGS. 2A-2D. For the purposes of illustration, the cross-sectional side view of FIG. 2E is taken along line 2C-2C of the mobile device 200 shown in FIG. 2A since the embodiment shown is similar to the embodiment of the mobile device 200 shown in FIG. 2A.

The mobile device 200 includes at the very least a first housing or shell 201 defining an interior space 202 housing a circuit board 203, an extended capacity battery 214 for providing electrical power to circuit board 203, and a loudspeaker 205. The circuit board 203 contains the operational electronics components comprising the mobile device 200 such as a numeric keypad, display, microprocessor, receiver/transmitter, microphone, and earpiece (none of which are shown). The loudspeaker 205 is connected to the circuit board 203. The loudspeaker 205 is acoustically coupled to a first acoustic chamber 207. The loudspeaker 205 is front ported so that the front volume sound of loudspeaker 205 is directed to the front of the mobile device 200 through a plurality of ports 206 defined in sidewall 208 of shell 201. An external acoustic chamber 250 is removably attached to the rear of mobile device 200 underneath the protruding portion of battery 214 and cover 215.

The external acoustic chamber 250 is defined by a second housing 251 and a second acoustic chamber 252. The external acoustic chamber 250 penetrates the volume of the first acoustic chamber 207 by one or more acoustic plugs or tubes 255 which extend from within the second acoustic chamber 252 and from second housing 251. The one or more tubes 255 fit info complementary respective one or more sockets 212 formed in the sidewall 208 of shell 201 (similar to the embodiment shown in FIG. 2B). The one or more tubes 265 and one or more sockets 212 serve as at least one port acoustically coupling the first acoustic chamber 207 and the second acoustic chamber 252. The one or more sockets 212 (FIG. 2B) receive the one or more tubes 255 when the second housing 251 is attached to sidewall 208 of shell 201. The one or more sockets 212 (FIG. 2B) define an opening for a channel 210 (similar to the embodiment shown in FIG. 2D) that acoustically couples to the first acoustic chamber 207. The channel 210 (FIG. 2D) is defined by a tubular sidewall 211 (FIG. 2D). The one or more tubes 255 are received in the channel 210 (FIG. 2D) of boss 211 (FIG. 2D) in a frictional type fit. In the exemplary embodiment of the invention, the tubes 255 and boss 211 are cylindrical. However, the invention is not limited in this regard and as the cross-sectional shape of tubes 255 and boss 211 could be of any cross-sectional shape known to one of ordinary skill in the art.

A seal 213 (FIG. 2B) may also be provided to seal the one or more tubes 255 in the one or more sockets 212 (FIG. 2B). The seal 213 (FIG. 2B) could also be used to seal the one or more sockets 212 (FIG. 2B) and the first acoustic chamber 207 before acoustic chamber 250 and the second housing 251 are attached to mobile device 200.

The frequency response of the loudspeaker 205 is improved because the additional volume of the second acoustic chamber 252 is added to the volume of the first acoustic chamber 207. The greater combined volume or acoustic space reduces the dampening of loudspeaker 205 caused by the pressure within the first acoustic chamber 207. The result is an improved frequency response of loudspeaker 205 that approaches the natural frequency response of loudspeaker 205.

Figure 3A:
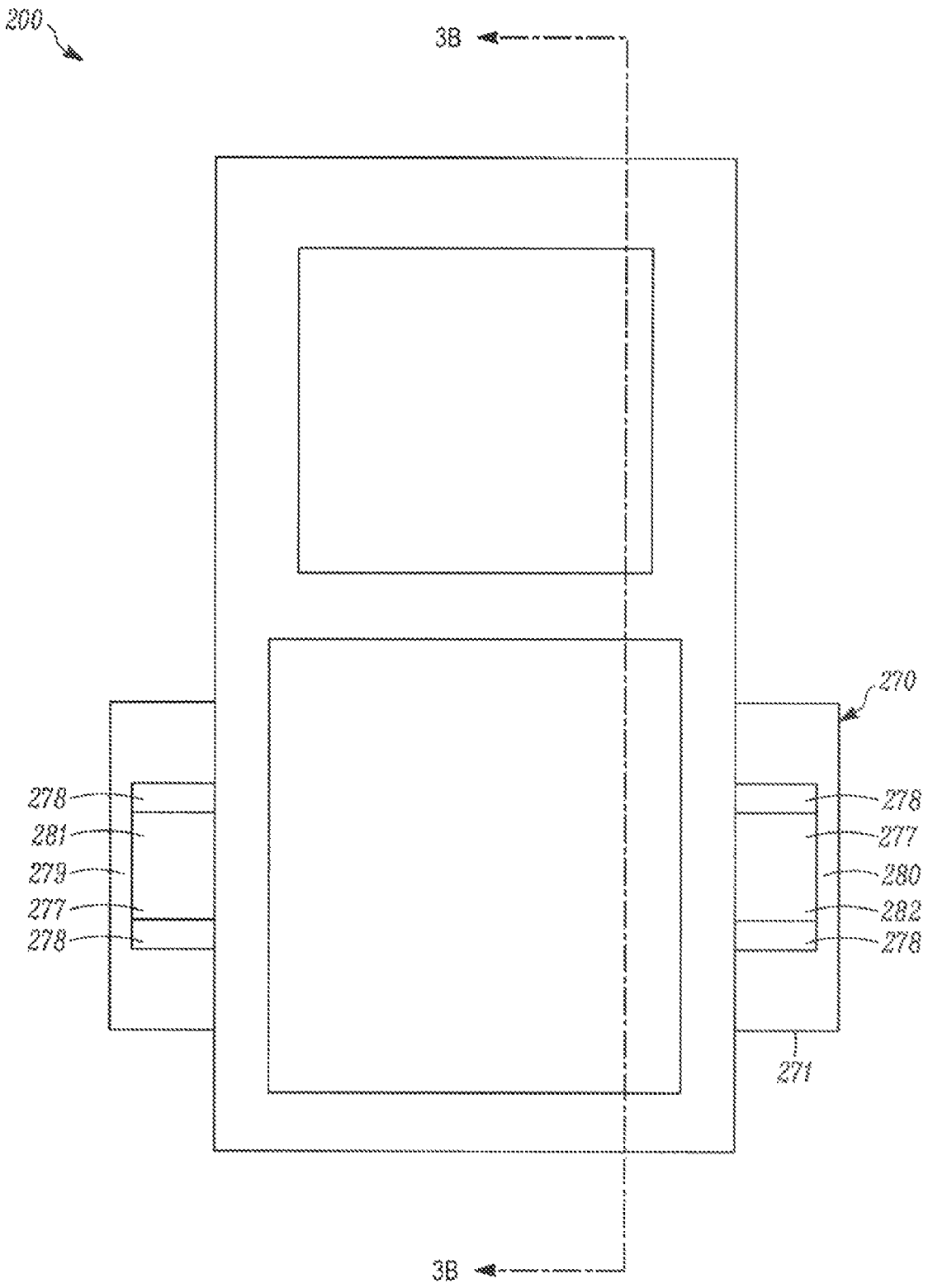
FIG. 3A is a front view of another embodiment of a mobile device.

Referring now to FIG. 3A, shown is a front view of another embodiment of a mobile device 200 similar to the embodiment shown in FIGS. 2A-2D. The mobile device 200 has an external acoustic chamber 270 removably attached for improving the audio performance of a loudspeaker 205 (FIG. 3B).

Figure 3B:
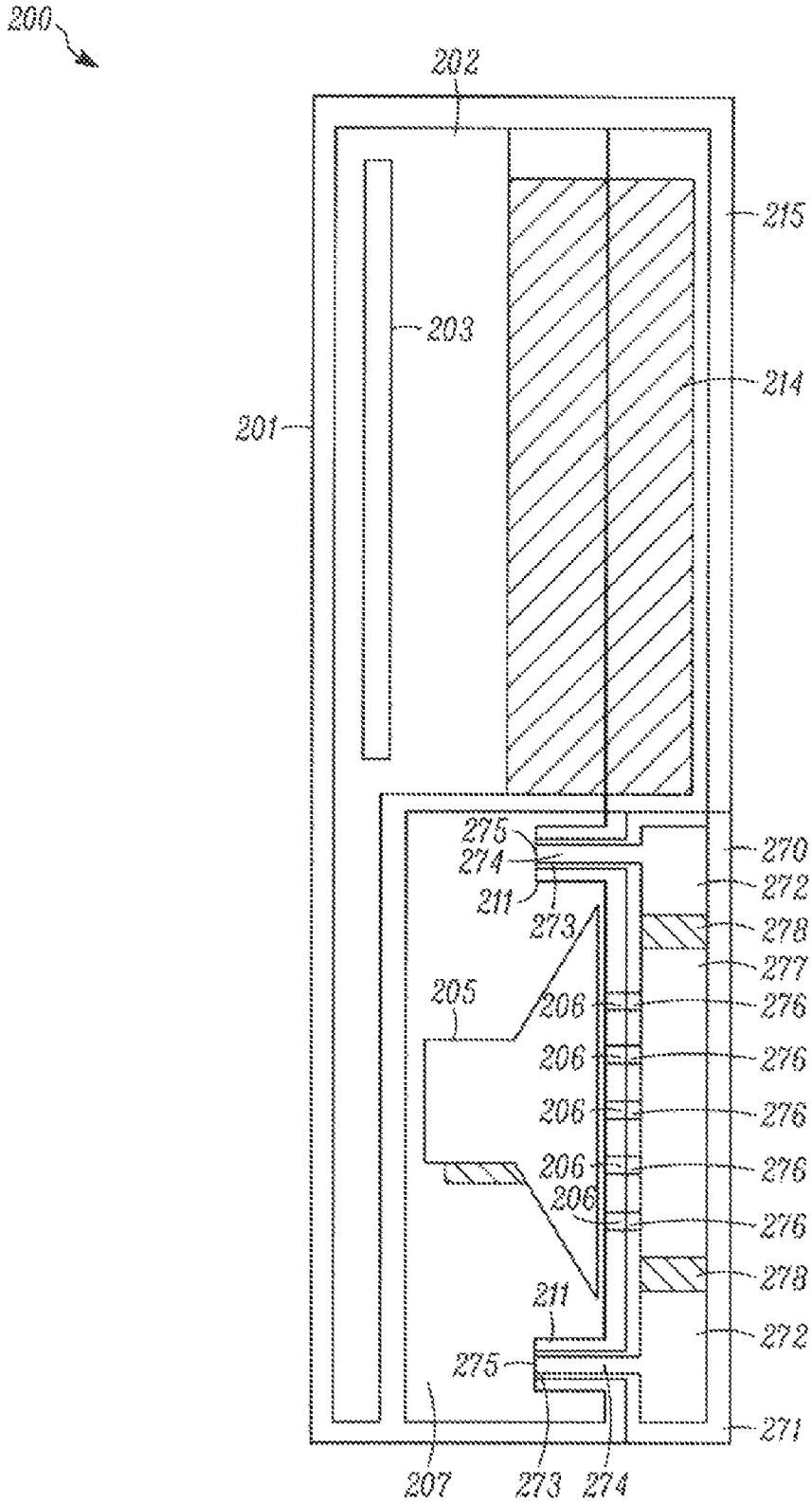
FIG. 3B is a cross-sectional side view of the embodiment of the mobile device of FIG. 3A taken along line 3B-3B of FIG. 3A having an extended capacity battery, extended capacity battery cover, rear ported loudspeaker, and an external acoustic chamber attached.

Referring now to FIG. 3B and still to FIG. 3A, shown is a cross-sectional side view of the embodiment of a mobile device 200 shown in FIG. 3A. The cross-sectional side view of FIG. 3A is taken along line 3B-3B of FIG. 3A. The mobile device 200 is comprised of at least a first housing or shell 201 defining an interior space 202 housing a circuit board 203, an extended capacity battery 214 for providing electrical power to circuit board 203, and a loudspeaker 205. The circuit board 203 contains the operational electronics components comprising the mobile device 200 such as a numeric keypad, display, microprocessor, receiver/transmitter, microphone, and earpiece (none of which are shown). The loudspeaker 205 is connected to the circuit board 203. The loudspeaker 205 is acoustically coupled to a first acoustic chamber 207. The loudspeaker 205 is rear ported so that the front volume sound of loudspeaker 205 is normally directed to the rear side of the mobile device 200 through a plurality of ports 206 defined in sidewall 208 of shell 201 similar to the rear ported loudspeaker 105 of FIGS. 1A-1C and 2B-2D.

In certain instances, it may be desirable to redirect the audio or front volume sound generated by loudspeaker 205 to the front side of the mobile device 200. For example, sound directed towards the listener is considered to be of a higher perceived quality than sound directed away from the listener.

In the present invention, this is done with an external acoustic chamber 270 which is attached to the rear side of mobile device 200 underneath the protruding portion of battery 214 and cover 215. The external acoustic chamber 270 penetrates the volume of the first acoustic chamber 207 to improve the frequency response of loudspeaker 205 in the manner previously discussed. The external acoustic chamber 270 also redirects the front volume sound of loudspeaker 205 to the front side of mobile device 200.

The external acoustic chamber 270 is defined by a second housing 271, at least one second acoustic chamber 272, and a third acoustic chamber 277. One or more sidewalls 278 divide the external acoustic chamber 270 into the at least one second acoustic chamber 272 and third acoustic chamber 277. One or more ports 276 align with the ports holes 206 for allowing the front volume sound of loudspeaker 205 to enter into the third acoustic chamber 277. The second housing 271 attaches to the rear side of mobile device 200 and has side portions 279, 280 that extend beyond the peripheral edges of shell 201. The side portions 279, 280 extend beyond the peripheral edges of shell 201 so that portions of the third acoustic chamber 277 also extend beyond the peripheral edges of shell 201. The side portions 279, 280 also define openings 281, 282 so that the front volume sound of loudspeaker 205 can exit from within the third acoustic chamber 277 and be directed to the front side of mobile device 200.

The external acoustic chamber 270 penetrates the volume of the first acoustic chamber 207 by one or more acoustic plugs or tubes 273 that are acoustically coupled to the at least one second acoustic chamber 272. The one or more tubes 273 fit into complementary respective one or more sockets 212 (like the embodiment shown in FIG. 2B) formed in the sidewall 208 of shell 201. The one or more tubes 273 and one or more sockets 212 (FIG. 2B) serve as at least one port acoustically coupling the first acoustic chamber 207 and the at least one second acoustic chamber 272.

The one or more sockets 212 (FIG. 2B) receive the one or more tubes 273 when the second housing 271 is attached to sidewall 208 of shell 201. The one or more sockets 212 (FIG. 2B) define an opening for a channel 210 (FIG. 2D) that acoustically couples to the first acoustic chamber 207. The channel 210 (FIG. 2D) is defined by a boss 211 (FIG. 2D). Thus, the one or more tubes 273 are received in the channel 210 (FIG. 2D) of boss 211 (FIG. 2D) in a frictional type fit.

A removable seal 213 (FIG. 2B) may also be disposed in the one or more sockets 212 (FIG. 2B) to seal the one or more tubes 273. The seal 213 (FIG. 2B) could also be used to seal the sockets 212 (FIG. 2B) and the first acoustic chamber 207 before the external acoustic chamber 270 is attached to mobile device 200. In the exemplary embodiment of the invention, the tubes 273 and boss 211 are cylindrical. However, the invention is not limited in this regard and as the cross-sectional shape of tubes 273 and boss 211 could be of any cross-sectional shape known to one of ordinary skill in the art.

The frequency response of the loudspeaker 205 is improved because the additional volume of the at least one second acoustic chamber 272 is acoustically coupled to the volume of the first acoustic chamber 207. The greater combined volume reduces the dampening of loudspeaker 205 caused by the pressure within the first acoustic chamber 207. The result is an improved frequency response of loudspeaker 205 that approaches the natural frequency response of loudspeaker 205.

Figure 4:
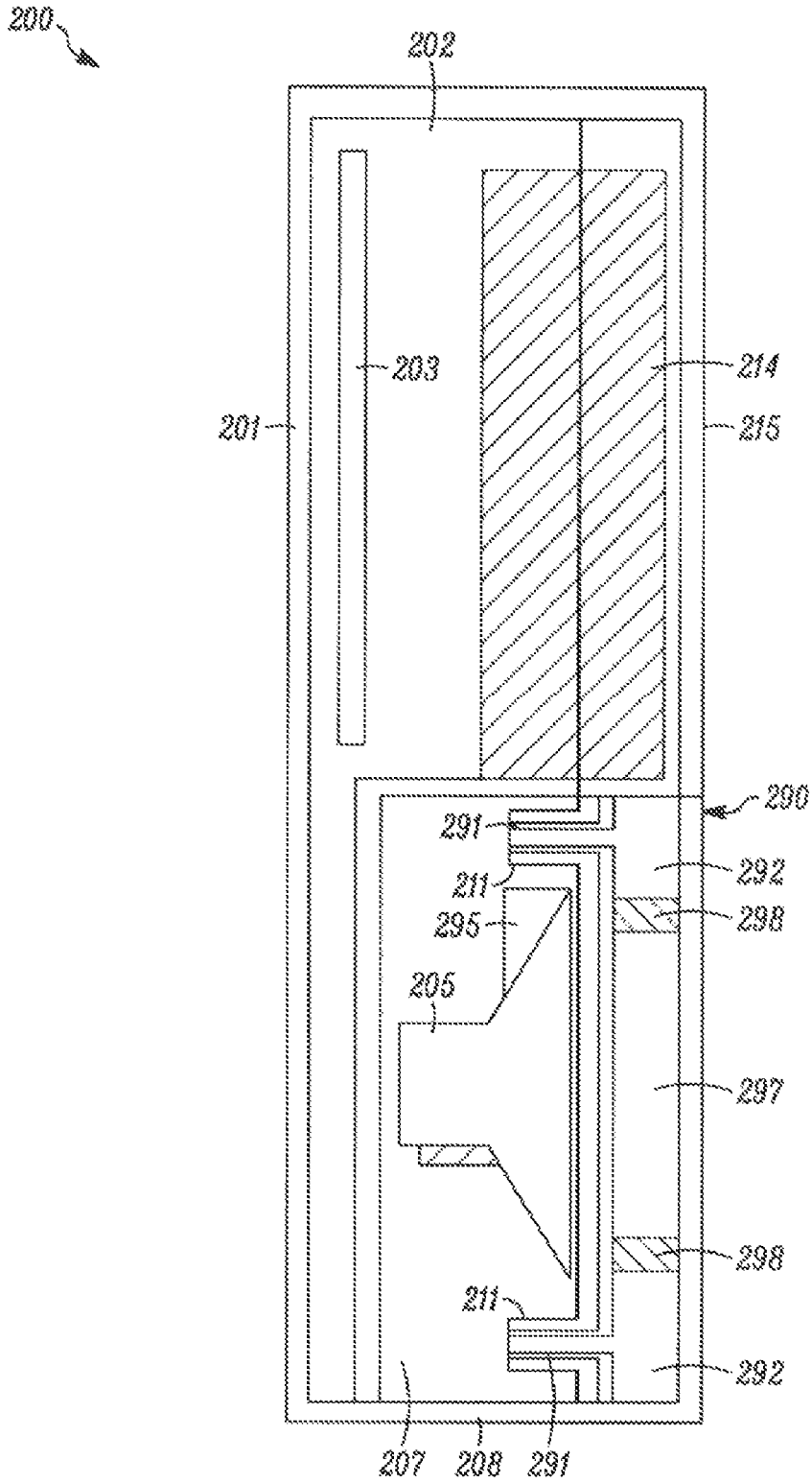
FIG. 4 is a cross-sectional side view of another embodiment of a mobile device similar to the mobile device of FIG. 3A taken along line 3B-3B of the mobile device of FIG. 3A having a sensing device to detect the attachment of an external acoustic chamber.

Referring now to FIG. 4, shown is cross-sectional side view of another embodiment of a mobile device 200 similar to the mobile device 200 shown in any one of FIGS. 2A-3D or FIGS. 3A-3B. For illustrative purposes, the cross-sectional side view of FIG. 4 is taken along line 2C-2C of the mobile device 200 of FIG. 2A since the embodiment shown is similar to the embodiment of the mobile device 200 shown in FIG. 4.

The mobile device 200 is comprised of at least a shell 201 defining an interior space 202 housing a circuit board 203, a battery 214 for providing electrical power to circuit board 203, and a loudspeaker 205. The circuit board 203 contains the operational electronics components comprising the mobile device 200 such as a numeric keypad, display, microprocessor, receiver/transmitter, microphone, and earpiece (none of which are shown). The loudspeaker 205 is connected to the circuit board 203. The loudspeaker 205 is acoustically coupled to a first acoustic chamber 207. The mobile device 200 could have a loudspeaker 205 that is rear ported like the mobile device 200 in FIGS. 2B-2D and FIGS. 3A-3B or front ported like the mobile device 200 in FIG. 2E.

An external acoustic chamber 290 could be attached to the rear of the mobile device 200 to improve the audio performance of the loudspeaker 205. The external acoustic chamber 290 further defines at least one second acoustic chamber 292 and a third acoustic chamber 297. At least one sidewall 298 divides the external acoustic chamber 290 into the at least one second acoustic chamber 292 and the third acoustic chamber 297.

When the external acoustic chamber 290 is attached to mobile device 200, the at least one second acoustic chamber 292 penetrates the first acoustic chamber 207 so that the volume of the at least one second acoustic chamber 292 is acoustically coupled to the volume of the first acoustic chamber 207. The frequency response of the loudspeaker 205 is improved with the additional volume of the at least one second acoustic chamber 292 acoustically coupled to the volume of the first acoustic chamber 207. The greater combined volume reduces the dampening of loudspeaker 206 caused by the pressure within the first acoustic chamber 207. The result is an improved frequency response of loudspeaker 205 that approaches the natural frequency response of loudspeaker 205.

The one or more tubes 291 extending from the at least one second acoustic chamber 292 are inserted into complementary respective one or more sockets 212 (similar to the embodiment shown in FIG. 2B) in the sidewall 208 of shell 201. The one or more tubes 273 and one or more sockets 212 (FIG. 2B) serve as at least one port acoustically coupling the first acoustic chamber 207 and the at least one second acoustic chamber 292.

The sockets 212 (FIG. 2B) receive the one or more tubes 291 when the external acoustic chamber 290 is attached to sidewall 208 of shell 201. The sockets 212 (FIG. 2B) define an opening for a channel 210 (FIG. 2D) that connects to the first acoustic chamber 207. The channel 210 (FIG. 2D) is defined by a cylindrical boss 211 (FIG. 2D). Thus, the one or more tubes 291 are received in the channel 210 (FIG. 2D) of boss 211 (FIG. 2D) in a fictional type fit.

A removable seal 213 (FIG. 2B) may also be disposed in the one or more sockets 212 to seal the one or more tubes 291. The seal 213 (FIG. 2B) could also be used to seal the one or more sockets 212 (FIG. 2B) and the first acoustic chamber 207 before the external acoustic chamber 290 is attached to mobile device 200. In the exemplary embodiment of the invention, the tubes 291 and boss 211 are cylindrical. However, the invention is not limited in this regard and as the cross-sectional shape of tubes 291 and boss 211 could be of any cross-sectional shape known to one of ordinary skill in the art.

The front volume sound of loudspeaker 205 could be directed into the third acoustic chamber 297 for allowing the front volume sound to pass through the external acoustic chamber 290 out the rear side of the mobile device like the mobile device 200 in FIGS. 2B-2D. Alternately, the front volume sound of loudspeaker 205 could be directed into the third acoustic chamber 297 and then further directed to the front side of the mobile device 200 as in FIGS. 3A-3B.

A sensing device 295 could be disposed in shell 201 in the proximal area where the external acoustic chamber 290 is attached to mobile device 200. The sensing device 295 is for detecting when the external acoustic chamber 290 is attached to mobile device 200. The sensing device 295 is connected to the circuit board 203 to notify the onboard electronics (not shown) that the external acoustic chamber 290 is attached. The electronics (not shown) on circuit board 203 could electronically adjust the equalization (EQ) to use less frequency boost to compensate for the improved natural frequency response due to the external acoustic chamber 290 being attached to mobile device 200.

The sensing device 295 could be a Hall Effect sensor, magnetic sensor, or a mechanical switch. However, the invention is not limited in this regard as any sensing device known to one of ordinary skill In the art could be used to detect when the external acoustic chamber 290 is attached to mobile device 200.

The external acoustic chamber 280 could be provided as an aftermarket product by itself or manufactured as a composite arrangement with the extended battery 214 and extended battery cover 215. The external acoustic chamber 290 when installed as a unitary product on mobile device 200 beneath battery 214 and battery cover 215 is designed to define a seamless, aesthetically pleasing mobile device 200 casement profile (see FIG. 2A). Similarly, the external acoustic chamber 290 when formed as a composite arrangement with the extended battery 214 and extended battery cover 215 installed on mobile device 200 define a seamless, aesthetically pleasing mobile device 200 casement profile (see FIG. 2A).

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, if will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A wireless mobile electronic device, comprising:

a first housing;

a first acoustic chamber disposed within said first housing;

a sound generator within said first housing acoustically coupled to said first acoustic chamber;

a second housing defining at least a second acoustic chamber, said second housing removably attached to said first housing, and said second housing further comprises a cover for a battery installed in said wireless mobile electronic device;

at least a first acoustic port configured for acoustically coupling said first acoustic chamber to said second acoustic chamber when said second housing is attached to said first housing.

2. The wireless mobile electronic device according to claim 1, wherein said first acoustic chamber further comprises at least a second acoustic port formed in said first housing for communicating audio from said sound generator to an exterior of said first and second housing.

3. The wireless mobile electronic device according to claim 2, further comprising a third acoustic chamber disposed in said second housing, and a third acoustic port configured for acoustically coupling said sound generator to said third acoustic chamber.

4. The wireless mobile electronic device according to claim 3, wherein said second housing further comprises first and second side portions which extend beyond peripheral edges of said first housing when said second housing is attached to said first housing, said first and second portions defining a channel extending said third acoustic chamber beyond said peripheral edges, and said first and second side portions each defining an opening configured for communicating audio from said sound generator to an exterior of said second housing.

5. The wireless mobile electronic device according to claim 1, wherein said at least one first acoustic port is comprised of a hollow tubular structure extending from a portion of said second housing.

6. The wireless mobile electronic device according to claim 5, wherein said at least one first acoustic port is further comprised of a socket formed on a portion of said first housing, said socket sized and shaped for snugly mating with said hollow tubular structure when said second housing is attached to said first housing.

7. The wireless mobile electronic device according to claim 1, wherein said first acoustic port is comprised of an opening formed in a portion of said first acoustic chamber.

8. The wireless mobile electronic device according to claim 7, further comprising a removable sealing member disposed in said opening for sealing said acoustic port when said second housing is not attached to said first housing.

9. The wireless mobile electronic device according to claim 1, wherein said second housing further comprises a cover for a battery installed in said wireless mobile electronic device.

10. The wireless mobile electronic device according to claim 1, wherein said battery is contained at least partially within said second housing.

11. The wireless mobile electronic device according to claim 10, wherein said battery has a size and shape which protrudes from said first housing, and said second acoustic chamber is sized and shaped so that a first exterior surface portion of said second housing covering said battery is substantially aligned with a second exterior surface portion of said second housing enclosing said second acoustic chamber.

12. The wireless mobile electronic device according to claim 1, further comprising at least one sensing device configured for detecting when said second housing is attached to said first housing.

13. The wireless mobile electronic device according to claim 12, further comprising audio processing means configured to modify an amplitude of selected audio frequencies communicated to said sound generator responsive to said sensing device.

14. The wireless mobile electronic device according to claim 12, wherein said at least one sensing device is selected from the group consisting of a Hall effect sensor, a magnetic sensor, and a switch.

15. An apparatus for improving audio performance of a mobile wireless electronic device defined by at least a first housing, a sound generator disposed in the first housing, and a first acoustic chamber acoustically coupled to the sound generator, the apparatus comprising:

a second housing comprising a cover for a battery installed in said mobile wireless mobile electronic device;

at least a second acoustic chamber defined by the second housing; and at least a first acoustic port extending from the housing, said at least one acoustic port configured for acoustically coupling said second acoustic chamber to said first acoustic chamber when said second housing is removably attached to said first housing.

16. The apparatus of claim 15, wherein said first acoustic chamber further comprises at least a second acoustic port formed in said first housing for communicating audio from said sound generator to an exterior of said first and second housing.

17. The apparatus of claim 16, further comprising a third acoustic chamber disposed in said second housing, and a third acoustic port configured for acoustically coupling said sound generator to said third acoustic chamber.

18. The apparatus of claim 15, wherein said first acoustic port is further comprised of a hollow tubular structure extending from a portion of said second housing, and a socket sized and shaped for snugly mating with said hollow tubular structure when said second housing is attached to said first housing.

* * * * *